US005526760A

United States Patent [19]

Ok

[11] Patent Number: 5,526,760

[45] Date of Patent: Jun. 18, 1996

[54] TUFTING MACHINE NEEDLE BAR SHIFTER

[75] Inventor: Thol Ok, Chattanooga, Tenn.

[73] Assignee: General Design, Inc., Rossville, Ga.

[21] Appl. No.: 289,704

[22] Filed: Aug. 12, 1994

[51] Int. Cl.[6] ..... D05C 15/30

[52] U.S. Cl. ..... 112/80.41; 74/89.2; 74/99 R

[58] Field of Search ..... 112/80.01, 80.23, 112/80.4, 80.41, 80.31, 80.73; 74/99 R, 108, 89.2, 136, 137, 138; 474/150, 273; 623/18, 20, 22; 403/52, 121, 291

[56] References Cited

U.S. PATENT DOCUMENTS

| | | | |
|---|---|---|---|
| 2,768,593 | 10/1956 | Lombard . | |
| 2,989,014 | 6/1961 | Dedmon . | |
| 3,016,029 | 1/1962 | Card . | |
| 3,108,553 | 10/1963 | Beasley . | |
| 3,160,125 | 12/1964 | Bryant et al. . | |
| 3,259,088 | 7/1966 | Rockholt . | |
| 3,547,058 | 12/1970 | Brown et al. . | |
| 3,978,800 | 9/1976 | Card et al. . | |
| 4,173,192 | 11/1979 | Schmidt et al. . | |
| 4,267,608 | 5/1981 | Bora, Jr. | 623/18 X |
| 4,597,344 | 7/1986 | Stutznacker | 112/80.41 X |
| 4,774,611 | 9/1988 | Ando | 74/89.2 X |
| 4,829,917 | 5/1989 | Morgante et al. | 112/80.41 |
| 5,205,229 | 4/1993 | Job | 112/80.41 |

OTHER PUBLICATIONS

"Operator's Manual for Card Tufting Machine" Dec.-©1976 by Tuftco Corp.; pp. i–v and 1–36.

*Primary Examiner*—Paul C. Lewis
*Attorney, Agent, or Firm*—Martin L. McGregor

[57] ABSTRACT

The present invention provides a tufting machine having a needle bar movable between at least two transverse locations in response to a control signal, a motor, a yarn supply, a backing cloth feed, a stitch drive, looper drive, yarn feed roller and all timed for moving the respective components at times in the stitch cycle when the needles are clear of the backing; the tufting machine operating to produce a series of stitches through the backing material by moving the needle bar to cause the needles to pierce the backing cloth and interact with the looper mechanism to produce a tufted fabric; and having a needle bar shifter comprising:

a frame having a first end and a second end;

a first belt attachment at the first end and a second belt attachment at the second end;

a roller mounted between the first and second belt attachments;

a belt attached to the first belt attachment looped around the roller and attached to the second belt attachment, a roller drive supplying rotational energy to the roller;

whereby activation of the drive turns the roller either clockwise or counter clockwise causing the belt to pull against the frame and thus shift an actuator from a first position to a second position making a corresponding shift in an attached needle bar from a first location to a second location. In a preferred embodiment the drive is an electrical servomotor and the control signal is generated by a computer. In contrast to prior art hydraulic systems, the servomotor response is linear and easily tuned. The shifting range, in practice, is limited by the ability of the yarn supply system to keep up with large changes in needle bar location rather than the system capacity limitations typically found in hydraulic systems.

18 Claims, 4 Drawing Sheets

TUFTING MACHINE NEEDLE BAR SHIFTER

TECHNICAL FIELD

This invention relates generally to tufting machines and, more particularly, to a novel actuator drive and power source to shift a tufting machine needle bar transversely relative to a fabric to be tufted.

BACKGROUND OF THE INVENTION

This invention includes a shift mechanism for transverse indexed movement of a tufting machine needle bar to extend the pattern making capabilities of a tufting machine, reduce noise and eliminate the dangerous work environment associated with hydraulic or pneumatic shifting systems.

In the production of tufted fabric it is known to jog or shift the needle bar in its longitudinal direction transversely across the tufting machine relatively to the backing material in order to create various pattern effects, to break up the unattractive alignment of the longitudinal rows of tufts and to reduce the effects of streaking which results from variations and colorations of the yarn.

Various devices have been proposed and are in use for controllably applying a step-wise force to the needle bar of a tufting machine in accordance with a pattern. Such needle shifting or stitch placement drives conventionally fall into two categories, cam driven and programmable shifting.

In the cam driven type a rotating plate cam is driven directly from the tufting machine main shaft, and engages the needle bar to effect the required displacement. The second category, the programmable type, is powered by a hydraulic or pneumatic drive, or driven mechanically through some form of programmable indexing device whereby a ram is drivingly engaged with the needle bar so as to effect the required displacement thereof. Examples of such drives are illustrated in U.S. Pat. Nos. 3,964,408 and 3,972,295, which utilize pawl and ratchet devices, U.S. Pat. Nos. 4,010,700 and 4,392,440 which utilize indexing devices and 4,173,192 which uses a hydraulic actuator.

Because of the greater reliability, simplicity and lower cost of a cam drive system, the cam driven needle bar shift remains the primary drive for supplying controlled step-wise force to the needle bar in accordance with the pattern information on the periphery of the pattern cam. Examples of such needle shifting devices are disclosed in U.S. Pat. Nos. 3,016,380, 3,934,524 and 4,445,447.

In the conventional cam driven needle bar shift apparatus, the cam acts on cam followers connected through drive rods and the like to the needle bar. The cam is rotatably driven through proper reduction apparatus from the main shaft of the tufting machine and rotates at a constant speed in synchronization with the movements of the needles, the hooks or loopers and the backing material. The cam serves to drive the needle bar in its longitudinal direction during that portion of the machine cycle when the needles are above and out of engagement with the backing material in which the stitches are to be formed so as to avoid interference between the needles and the needle plate or other portions of the machine. The needles are clear of the backing only during a small portion of the cam circumference so that only this portion of the cam circumference is available for controlling the transverse needle bar movement while the remaining portion of the cam circumference is of a constant radius and merely idles the needle bar in place. Thus, the number of needle bar movements for a given cam is limited, and the stitch pattern repeat is similarly restricted due to the relationship between the "dwell" time, i.e., the period within a machine cycle when the needles are engaged with the backing material and no longitudinal shift of the needle bar can occur, and the "displacement" time, when the needles are withdrawn from the backing and the needle bar is jogged.

Typically, the needle bar is shifted or jogged laterally across the machine during approximately 120° to 180° of the needle bar reciprocation cycle so that the "displacement" time using a conventional cam driven shifter is approximately 33 percent to 50 percent of the machine cycle and of the circumference of the cam, with the remaining 50 to 67 percent of the cam circumference and machine cycle being an idle surface or the "dwell" time. Thus, for a major part of its rotation the cam is precluded from affecting shifting of the needle bar.

If the surface of the cam is divided into sectors equal in number to the number of stitches in the pattern, the angular distance from a point in one sector to a similarly disposed point in an adjacent sector is the angle the cam must rotate for each revolution of the tufting machine main shaft and for each cycle of the needle bar. Because of this, and because of the small surface available for a follower to ride upon each sector of a practical sized cam, the number of sectors into which the cam may be divided, and hence the number of stitches in a pattern produced by the cam, is limited. Moreover, because of the small amount of time available for needle bar displacement, coarse cam profiles must be utilized for the displacement step, thereby giving rise to problems of inertia in relation to the needle bar and militating against accurate and smooth needle bar movement. Because of the abrupt changes in the shape of the cam surface to produce the required abrupt directional reversals of the movement of the needle bar as the cam rotates, problems arise with regard to ensuring that the cam follower runs smoothly on the cam surface and it is difficult to achieve satisfactory pattern control in the case of high speed tufting machines. Additionally, the need for rapid transition between the "dwell" and "displacement" portions of the total cam profile require that cam followers of relatively small size be utilized, which in itself gives rise to further problems relating to dynamic response characteristics. Such systems are inherently noisy in operation due to the clicking sounds produced by the collisions of the cam follower with the cam pattern changes. The cam is limited to a relatively small number of shifts for each pattern. To change patterns the cam must be changed, requiring the machine to be out of production while the pattern cam is changed.

The limitations of a cam shifting means are overcome in part by programmable shifting systems but such systems also involve a new set of problems. Hydraulic and pneumatic systems operate under high fluid pressures which eventually leak and fail due to loss of fluid pressure. Pressure failure during a bar shift may result in a partial shift, causing the needles to contact the loopers or needle plate, often requiring replacement of all loopers and needles and rethreading of all needles. A large commercial tufting machine will often carry over 1,000 needles per needle bar, and many machines carry two independent bars. On these large systems a needle bar crash may result in the loss of several thousand dollars in replacement of bent or broken needles and loopers, as well as the loss of one or more full days of production from the damaged machine. Leaking hydraulic fluids also present a cleanliness problem, and safety, health and environmental problems for the machine operators. Pneumatic systems are noisy, and high pressure gas lines also present safety problems for the operator.

Ratchet and pawl type shift mechanisms are complex, noisy and limited in the range of patterns that can be programmed. Very few, if any are currently in commercial use. Even in the widely used hydraulic shifted machines, the maximum transverse shift range in large scale commercial tufting machines is limited to about three inches of total needle bar displacement, and much less shift capacity is normally available in com or ratchet and pawl type machines.

The shifting range is limited in hydraulic shifting machines by the amount of hydraulic fluid a particular system can supply at full pressure to drive the actuator. In hydraulic systems the valve response is proportional to the control signal, but the response is nonlinear causing over shift or under shift and requiring careful control circuit tuning to avoid stability problems or poor dynamic response. These factors result in a limiting of the practical shifting range of hydraulic or pneumatic systems to about 1.5 inches right and left of center, or a total shift range of about 3.0 inches.

SUMMARY OF THE INVENTION

The present invention provides a tufting machine, a tufting method and a shifter mechanism for moving a needle bar transversely while the needles of the machine are clear of the backing, while avoiding the disadvantages of the prior art machines.

It is an object of the present invention to provide a tufting machine having a needle bar movable between at least two transverse locations in response to a control signal, a motor, a yarn supply, a backing cloth feed, a stitch drive, looper drive, yarn feed roller and all timed for moving the respective components at times in the stitch cycle when the needles are clear of the backing; the tufting machine operating to produce a series of stitches through the backing material by moving the needle bar to cause the needles to pierce the backing cloth and interact with the looper mechanism to produce a tufted fabric; and having a needle bar shifter comprising:

a frame having a first end and a second end;

a first belt attachment means at the first end and a second belt attachment means at the second end;

a roller mounted between the first and second belt attachment means;

a belt attached to the first belt attachment means, looped around the roller and attached to the second belt attachment means;

a roller drive supplying rotational energy to the roller; whereby activation of the drive turns the roller either clockwise or counter clockwise causing the belt to pull against the frame and thus shift an actuator from a first position to a second position making a corresponding shift in an attached needle bar from a first location to a second location.

In a preferred embodiment the drive means is an electrical servomotor and the control signal is generated by a computer. In contrast to prior art hydraulic systems, the servomotor response is linear and easily tuned. The shifting range, in practice, is limited by the ability of the yarn supply system to keep up with large changes in needle bar location rather than the system capacity limitations typically found in hydraulic systems.

In a preferred embodiment a plurality of servomotors may be used. A preferred servomotor is a brushless electrical motor such as Model M866-B supplied by Magnetek of New Berlin, Wis.

In a preferred sub-assembly, rotational force from one or more electrical servomotors is converted to linear motion of the frame by a reduction arm attached to the roller which comprises a first and a second belt attachment means; a wheel mounted between the first and second belt attachment means; the wheel attached to the rotary drive; a belt attached to the first belt attachment means; passed around the wheel and attached under tension to the second belt attachment means; whereby activation of the rotary drive means pulls the reduction arm to move the reduction arm which turns the roller and moves the frame from a first location to a second location in a substantially linear motion.

It is a further object of this invention to provide a method of tufting which comprises the steps of predetermining a stitch pattern to be tufted on a fabric backing; converting the stitch pattern to a set of position instructions responsive to a position feedback signal; feeding a backing material through a tufting machine at substantially a right angle to a needle bar; moving a laterally shiftable needle bar in timed relationship to the backing such that the needles are clear of the backing at a time when the needle bar is shifted laterally by activating a rotary power means responsive to the position instruction set; the rotary power means being coupled to a linear motion transfer means operably linked to the needle bar and positioning the needle bar at stitch locations aligned with the tufting machine looper means; stitching a predetermined pattern by positioning the needle bar at predetermined stitch locations aligned with the looper means and feeding the backing through the tufting machine such that sequential stitches are produced in the backing fabric according to the program instruction set and shifting the needle bar to produce a patterned tufted fabric.

Preferably, the instruction set is generated by a computer program and needle bar position is determined by sensing its location from a transducer mounted on the needle bar and relaying the positional signal to the computer program which responds to the location signal by implementing the next positioning signal in timed relationship to a sensed needle bar position signal in timed relationship to the vertical position of the needle bar and backing position such that the needle bar transverse motions only occur when the needles are clear of the backing fabric. Moving the needle bar transversely with sufficient transverse velocity that the needle bar is positioned at the next looper alignment position before the needles again penetrate the backing material is accomplished by activating the servomotors, sensing the new actuator position and comparing new positions to the desired position.

DESCRIPTION OF THE DRAWINGS

For a more complete understanding of the present invention and the advantages thereof, reference is made to the following descriptions taken in conjunction with the accompanying drawings, in which.

DETAILED DESCRIPTION OF THE INVENTION

The following explicit embodiments are intended to illustrate and describe specific embodiments of the invention, and not to narrow or circumscribe the invention as claimed.

Figure 1:
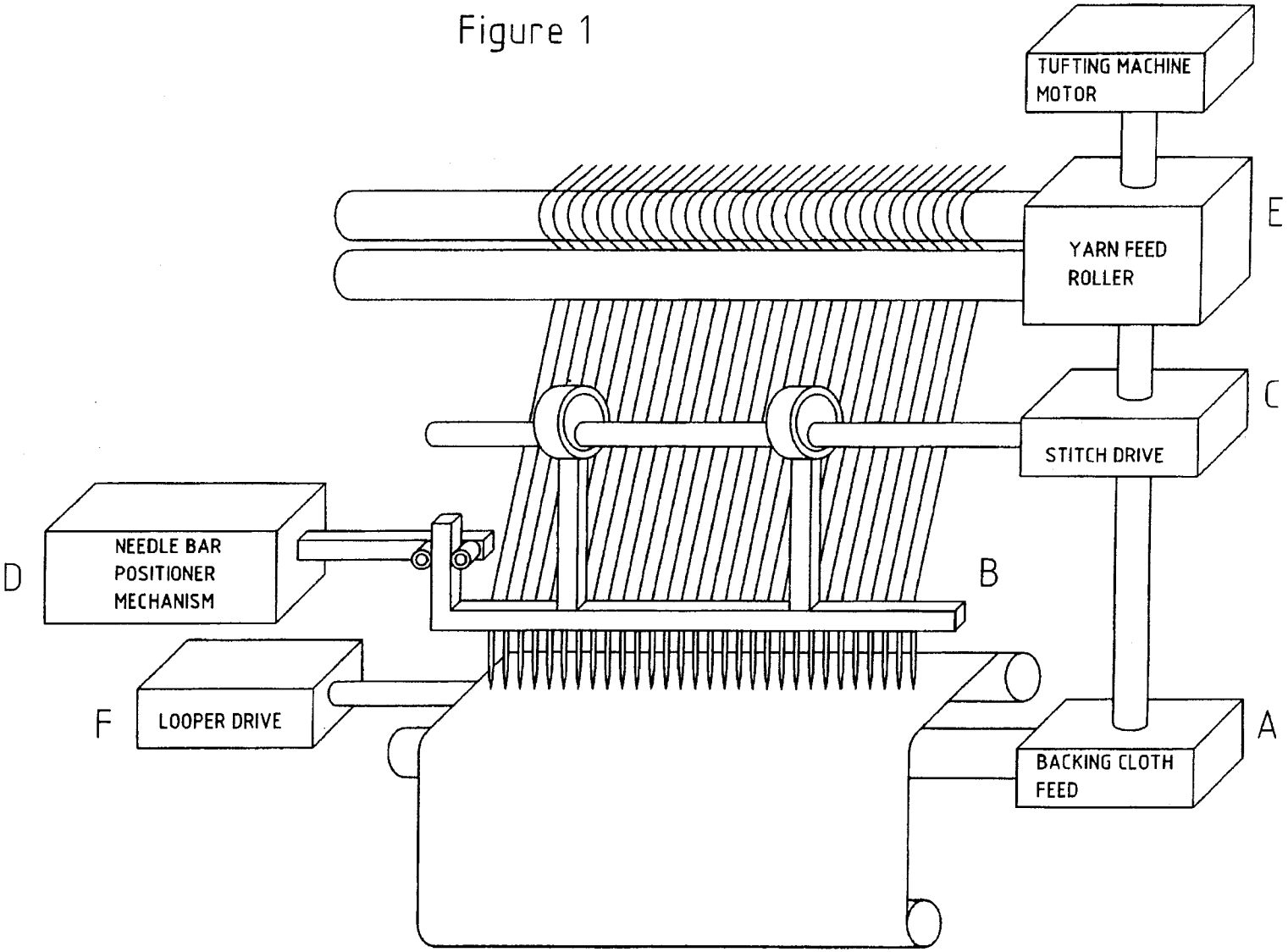
FIG. 1 is a schematic of a tufting machine with a needle bar shifting mechanism according to the present invention.

Referring to FIG. 1, a conventional tufting machine is shown in schematic form, illustrating the basic components of a backing cloth feed A, which moves a backing material or cloth past needle bar B which is driven in the vertical plane by stitch drive C and transversely at substantially right angles to the backing material by needle bar shifter mechanism D. Optionally the tufting machine may also include a yarn feed roller E and supplemental yarn feeding and control means (not shown) to provide the capacity to speed up or slow down yarn supply to individual needles. The yarn or thread is supplied to individual needles in the needle bar which may be one or more needles for each looper mechanism (not shown), generally located on the opposite side of the backing material from the needle bar in a spaced relationship corresponding to the spaced needle locations on needle bar B. The loopers are driven by looper drive F in synchronization with the stitch drive C, yarn feed roller E, needle bar shifter D and backing cloth feed A such that the loopers engage a loop of yarn carried through the backing material to complete the stitch and optionally may also include a knife which cuts the loop to produce a cut pile material. The needle bar D will normally carry a large number of needles with large commercial machines often using over 1000 needles and loopers.

Movement of the backing material is synchronized with the stitch drive such that the backing is moved when the needles are clear of the fabric. The transverse motion of the needle bar must also be synchronized with the stitch drive such that transverse movements of the needle bar can only occur when the needles are clear of the backing material. Transverse motion must also be carefully indexed to precisely locate the needle bar in the proper vertical location, which is directly aligned with the looper stations such that needles only enter the backing material at locations where the needle can carry the yarn to the loopers free of obstructions and without contacting the looper mechanism.

Synchronization and indexing functions have been historically accomplished by mechanical linkages, but in modern machines these functions are increasingly controlled by computer generated control signals. Computer systems respond to one or more position signals to time operation of the various drive components. Some drive components may be mechanically linked to the tufting machine motor, or, optionally one or more additional motors or power sources, each independently controlled by the computer.

Patterned materials may be produced by supplying differently colored threads to various needles, shifting the needle bar position relative to the backing, supplying different colors to multiple needles at each location, shifting between needles to change yarn color or texture at each needle location giving additional variations of pattern. Pattern production is controlled by a predetermined instruction set or program supplied to the computer.

In a preferred control system the machine component position information is supplied to the computer in a closed loop feedback system. The component location signals are constantly sampled by the computer, and compared to a predetermined desired location value. In response to the difference between the actual location value and the desired location value the computer generates a control signal, which is communicated to the appropriate drive power supply to activate a drive mechanism in a direction and magnitude to change the location such that the location signal will be equal to the predetermined location signal value. A new location value is obtained by again sampling the location signal, comparing it to the desired location value and repeating the positioning cycle. In such a control system the computer controller is constantly seeking to match the desired value by a series of increasingly smaller steps around the desired positional values. Location signals may be supplied by encoders or by transducers or other location signal generating means known to those skilled in the computer control art.

Figure 2:
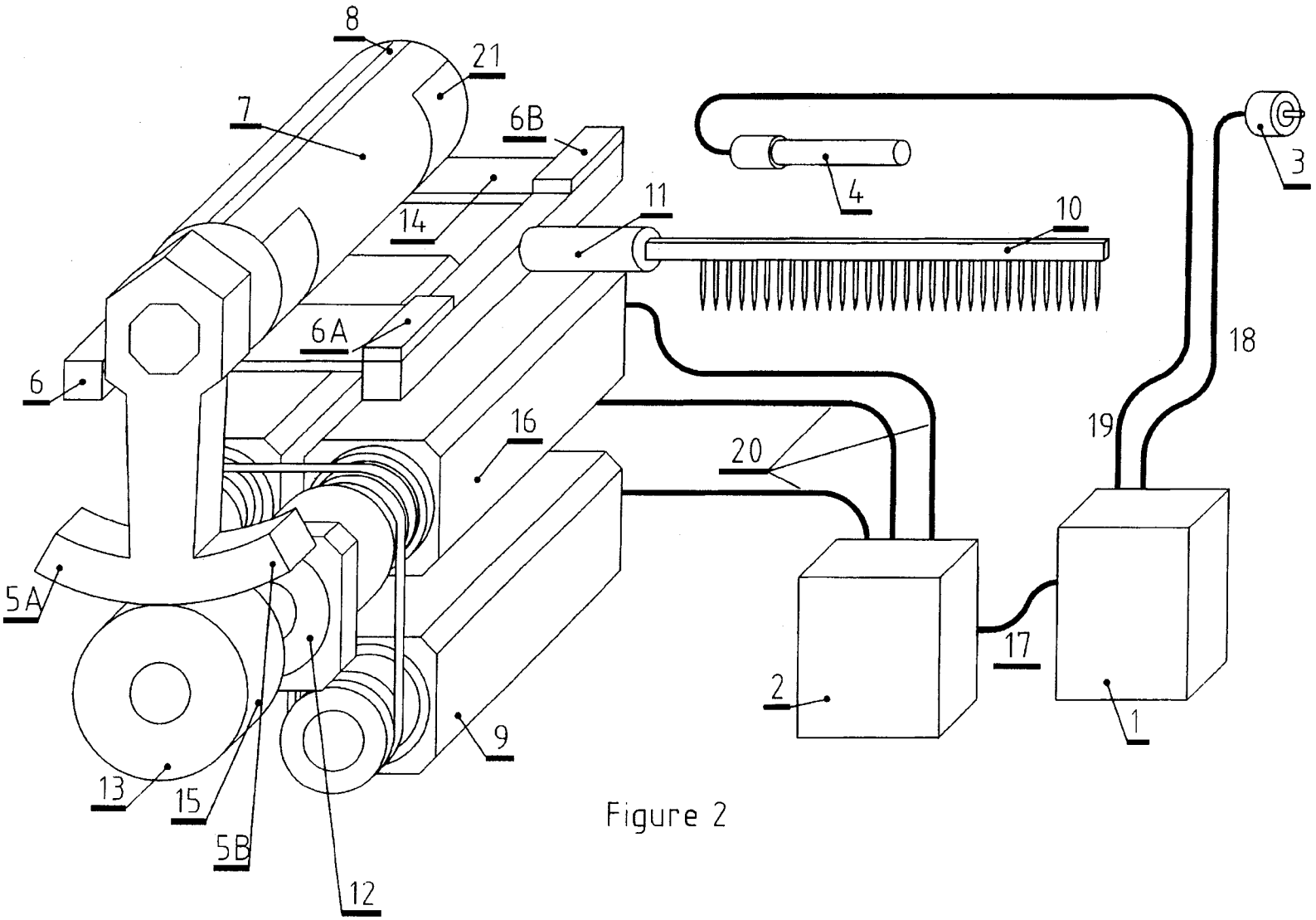
FIG. 2 is an isometric view of one embodiment of a needle bar shifting mechanism for a conventional tufting machine.

Referring to FIG. 2, the computer control system 1 includes a conventional pattern control program loaded from conventional storage media such as a "floppy disk" an erasable, programmable read only memory chip (EPROM), a fixed drive and cd-rom or other media. A suitable computer control program is available from General Design, Inc. P.O. Box 516 Rossville, Ga. 30741. When the tufting machine control computer is activated by the operator, the control program verifies that the machine is at rest at the predetermined "home" position of the main drive shaft and needle bar transverse location. Main drive shaft position information is read from encoder 3 which provides a main shaft rotational position information signal via lead wire 18 to computer control 1. Transducer 4 provides needle bar transverse position information signals to computer control 1, preferably by a closed loop feedback system. The computer control system reads the encoder and transducer signals, compares actual control signal values from the encoder 3 and transducer 4 against the predetermined program values and responds by generating a signal in lead 17 to power amplifier and drive supply 2 which produces a directional electrical current in wire 20 and activates servomotors 9 and 16 at a time when the needle bar is in a position in which the needles are clear of the backing, as determined by the positional signal from encoder 3. The computer control system moves the needle bar to match each programmed transducer positional value, shifting the needle bar to the next stitch position according to the desired pattern.

The computer command signal is carried via lead wire 17 to power amplifier and drive 2 activating primary servomotor 16 and secondary servomotor 9 to turn optional reduction gear 12, rotating drive roller 13 which pulls on belt 15 moving reduction arm 5, to rotate roller 21, either clockwise or counterclockwise, which pulls belt 7 against belt attachments **6*a* or 6*b* on either end of frame 6 acting against actuator 11 which is linked to the needle bar and shifts the transverse position of needle bar 10 relative to the backing and loopers (not shown). Needle bar 10 of FIG. 2 corresponds to needle bar B in FIG. 1**.

In accordance with the pattern control program the needle bar may be shifted only in multiples of the spacing between the loopers according to a pattern control program to produce a desired stitch pattern. In contrast to the limitations of the cam pattern systems, the needle bar can be shifted as desired whenever the needle bar is clear of the backing fabric limited only by the feeding capabilities of the yarn supply to compensate for rapid changes in the distance between each needle and its yarn supply. Pattern changes require only a change to the program instructions with no change required in the machine.

The shifting mechanism of FIG. 2 can be used to move any independently powered working tool across a work piece in response to positional information supplied by a position detection means (such as a transducer) to a computer or other numeric control system.

The shifting mechanism belt drive system is designed to greatly reduce the mechanical backlash found in screw or gear drive systems. For example if the optional reduction gear 12 is a 10:1 ratio gear available from Magnetek of New Berlin, Wis., the design backlash is 0.05 inches when the gear train direction is reversed. Such backlash must be eliminated or reduced to an acceptable tolerance for the positional accuracy required in a tufting machine. To operate properly in a high speed tufting machine the needle bar must be accurately aligned with the loopers within about 0.001 inches or the needles may crash against the loopers, which damages the needles, loopers or both and also may stop production from the machine during the repair time.

To eliminate mechanical lost motion or backlash, the belt material must have essentially no stretch. While any belt material having the necessary low stretch characteristic may be used, the best belt material currently known to the inventor is made by Metal Belt Technologies of Agawan, Mass., Part Number 301, Hi-yield stainless belts. The belts 7 and 15 are attached to rollers 21 and 13 under tension between attachment means *6a* and *6b* or *5a* and *5b* respectively, to further reduce backlash when servomotor rotation is reversed to move the frame in the opposite direction, to correct a positional overshot or to stop transverse motion. The mechanical advantage gained by reduction arm 5, and reduction drive 12 may allow using one primary servomotor 16 for positioning of a needle bar. When used with an especially heavy bar, or for high speed operation where motor inertia maybe a critical factor, the present design also permits using one or more secondary servomotors 9.

Figure 3:
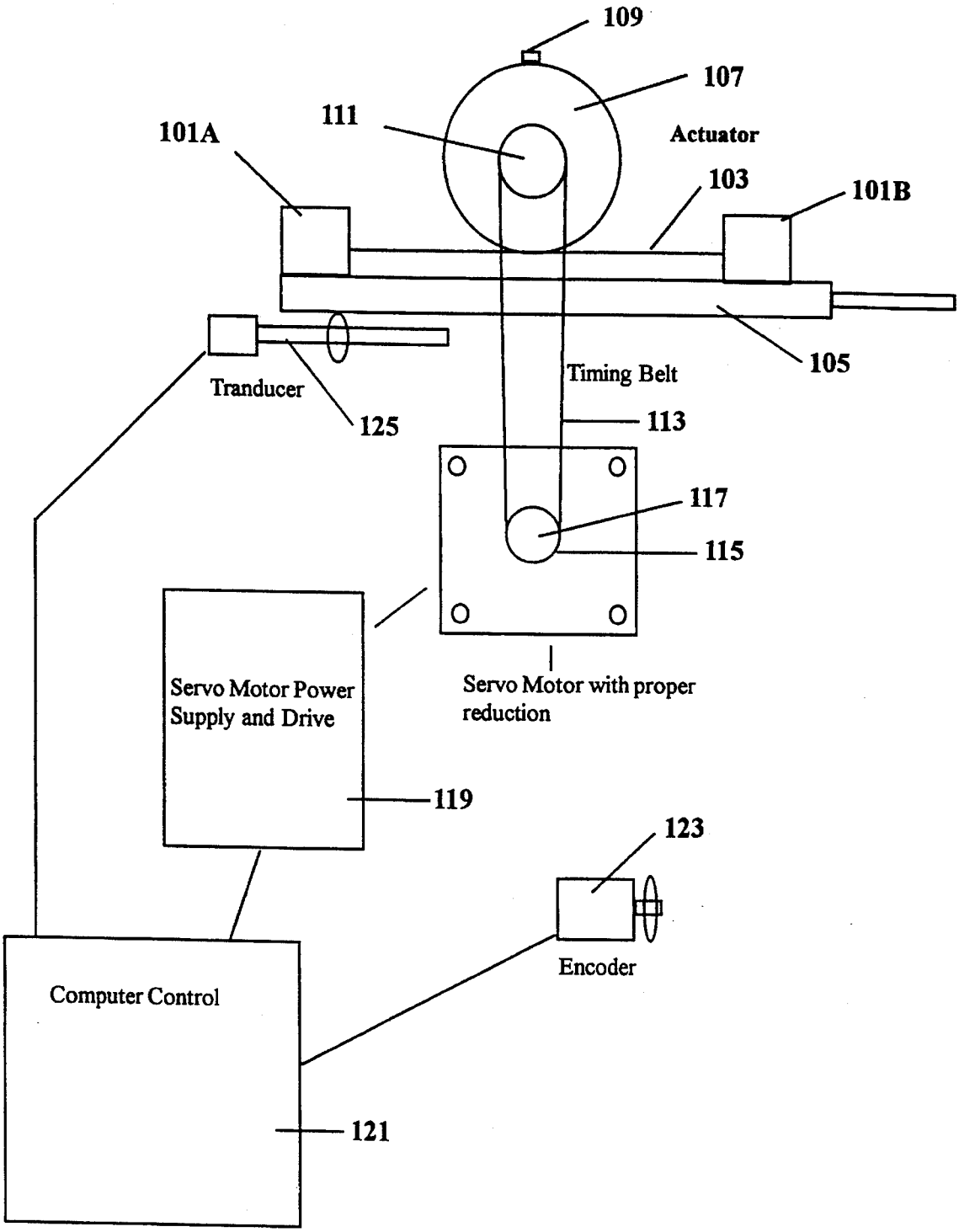
FIG. 3 is a side view of another embodiment of a belt and roller needle bar shifter.

In an alternate embodiment illustrated in FIG. 3 the reduction arm 5, wheel 13 and belt 15 are replaced by pulleys and a timing belt. Referring now to FIG. 3, an alternate embodiment of a belt and roller shifter is shown in side view with the components of the control and drive system illustrated by a schematic diagram. Belt attachment means 101 connects belt 103 (shown in plan view in FIG. 4) to actuator bar 105. Belt 103 is wrapped around roller 107 and is optionally attached to roller 107 by belt attachment means 109. Roller 107 is driven by drive pulley 111, timing belt 113, electrical servomotor 115 and motor pulley 117. Servomotor power supply 119 is activated on signal from conventional computer controller 121 in response to encoder position signals from encoder 123 to activate servomotor 115 rotating pulley 117 to move timing belt 113 in turn rotating pulley 111 causing roller 107 to rotate pulling against belt 103 and pulling against attachment means **101*a* or 101*b* causing transverse movement of actuator bar 105 as either 101*a* or 101*b* is drawn nearer to roller 107. The transverse movement of bar 105 is detected by transducer 125 and the new position signaled to computer controller 121 which stops servomotor power supply 119 ending the travel of actuator 105 at the next predetermined stitch position as indicated by the positional signal from transducer 125. All transverse movement of actuator 105 occurring while needle bar 10** is in the upper position with needles clear of the backing material.

Figure 4:
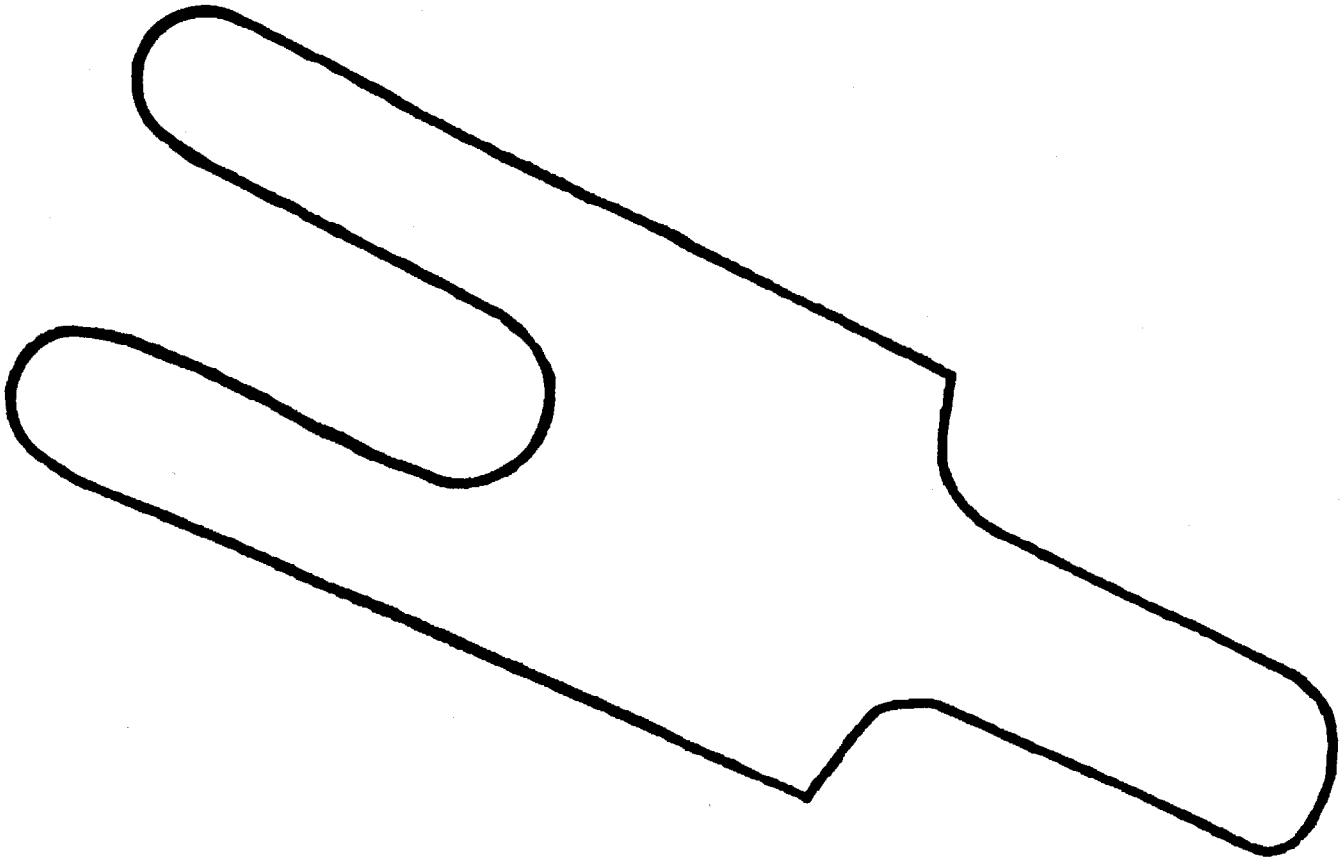
FIG. 4 is a plan view of a belt suitable for use in the belt and roller actuator of FIG. 3.

Referring to FIG. 4, a plan view of a belt suitable for use with the roller and belt shifter mechanism is shown. The distribution of material between the ends of the belt should be equal and symmetrical, however, numerous variations of configuration can be employed for the belt configuration.

Although specific embodiments have been described and illustrated, those skilled in the art will recognize numerous substitutions of mechanical equivalents that may be made for the components described herein without departing from inventive concept described herein. For example the term "roller" as used herein encompasses many variations of motion transfer structures adapted to transmit a mechanical pull in either direction on a belt and convert a substantially rotary motion to a substantially linear motion with a mechanical advantage. Although the present invention and its advantages have been described in detail, it should be understood that various changes, substitutions and alterations can be made without departing from the spirit and scope of the invention as defined by the following claims.

I claim:

1. A tufting machine having a needle bar movable between at least two transverse locations in response to a control signal, a motor, a yarn supply, a backing material, a backing material feed, a stitch drive, looper drive and a yarn feed roller, all of which are timed for moving the respective components at times in the stitch cycle when the needles are clear of the backing material; the tufting machine operating to produce a series of stitches through the backing material by moving the needle bar to cause the needles to pierce the backing material and interact with the looper drive to produce a tufted fabric; and having a needle bar shifter comprising:

a frame having a first end and a second end;

a first belt attachment means at the first end and a second belt attachment means at the second end;

a roller fixed relative to the frame between the first and second belt attachment means;

a belt attached to the first belt attachment means, looped around the roller and attached to the second belt attachment means;

a roller drive supplying rotational energy to the roller; whereby activation of the drive turns the roller either clockwise or counter clockwise causing the belt to pull against the frame and thus shift the frame from a first position to a second position making a corresponding shift in an attached needle bar from a first location to a second location.

2. A tufting machine according to claim 1 wherein the drive is an electrical servomotor.

3. A tufting machine according to claim 2 wherein the drive is a plurality of electrical servomotors.

4. A tufting machine according to claim 1 in which a control signal is supplied by a transducer that specifies the transverse position of the needle bar.

5. A tufting machine according to claim 1 which is controlled by a computer.

6. A tufting machine according to claim 1 in which the belt is attached to the roller.

7. A tufting machine according to claim 1 in which the belt is a metal belt.

8. A tufting machine according to claim 1 in which the belt is stainless steel.

9. A tufting machine according to claim 1 in which the roller drive supplies rotational energy to the roller by means of a reduction arm, the reduction arm having a base and a double ended tee-head, the base being attached to the roller and the tee-head communicating with a wheel by means of a belt attached to one end of the tee-head passed around the wheel and attached under tension to the other end of the tee-head, and the wheel being driven by the roller drive.

10. A needle bar shifter comprising:

a frame having a first end and a second end;

a first belt attachment means at the first end and a second belt attachment means at the second end;

a roller fixed relative to the frame between the first and second belt attachment means;

a belt attached to the first belt attachment means, looped around the roller and attached to the second belt attachment means;

a roller drive supplying rotational energy to the roller;

whereby activation of the drive turns the roller either clockwise or counter clockwise causing the belt to pull against the frame and thus shift the frame from a first position to a second position making a corresponding shift in an attached needle bar from a first location to a second location.

11. A needle bar shifter according to claim 10 wherein the drive is an electrical servomotor.

12. A needle bar shifter according to claim 11 wherein the drive is a plurality of electrical servomotors.

13. A needle bar shifter according to claim 10 in which a control signal is supplied by a transducer that specifies the transverse position of the needle bar.

14. A needle bar shifter according to claim 10 which is controlled by a computer.

15. A needle bar shifter according to claim 10 in which the belt is attached to the roller.

16. A needle bar shifter according to claim 10 in which the belt is a metal belt.

17. A needle bar shifter according to claim 10 in which the belt is stainless steel.

18. A needle bar shifter according to claim 10 in which the roller drive supplies rotational energy to the roller by means of a reduction arm, the reduction arm having a base and a double ended tee-head, the base being attached to the roller and the tee-head communicating with a wheel by means of a belt attached to one end of the tee-head passed around the wheel and attached under tension to the other end of the tee-head, and the wheel being driven by the roller drive.

* * * * *